US009067771B2

(12) United States Patent
Running

(10) Patent No.: US 9,067,771 B2
(45) Date of Patent: Jun. 30, 2015

(54) SWING FRAME ROLL CLAMP

(71) Applicant: Cascade Corporation, Fairview, OR (US)

(72) Inventor: Brent G. Running, Hood River, OR (US)

(73) Assignee: Cascade Corporation, Fairview, OR (US)

( * ) Notice: Subject to any disclaimer, the term of this patent is extended or adjusted under 35 U.S.C. 154(b) by 69 days.

(21) Appl. No.: 13/968,055

(22) Filed: Aug. 15, 2013

(65) Prior Publication Data

US 2014/0353993 A1 Dec. 4, 2014

Related U.S. Application Data

(60) Provisional application No. 61/830,742, filed on Jun. 4, 2013.

(51) Int. Cl.
*B66C 1/42* (2006.01)
*B66F 9/18* (2006.01)

(52) U.S. Cl.
CPC ..... *B66F 9/184* (2013.01)

(58) Field of Classification Search
CPC ..... B66C 1/54; B66C 1/48; B66C 3/16; B66C 1/02; B65G 47/91; B65G 47/90; H01L 21/68707; B25J 15/0009; E21B 31/18; B65D 71/50; B66F 9/184; B66F 9/183; B66F 9/18; B66F 9/188
USPC ..... 294/86.41, 188, 189, 901, 902, 106, 294/86.29, 198, 87.1, 87.22; 414/620–623, 414/607, 627
See application file for complete search history.

(56) References Cited

U.S. PATENT DOCUMENTS

| | | | | |
|---|---|---|---|---|
| 3,059,099 | A | 10/1962 | Carpenter et al. | |
| 3,367,705 | A | 2/1968 | Ames | |
| 4,177,000 | A * | 12/1979 | Weinert et al. | 414/620 |
| 4,227,850 | A * | 10/1980 | Farmer et al. | 414/620 |
| 4,516,905 | A * | 5/1985 | Cavin et al. | 414/620 |
| 4,640,661 | A * | 2/1987 | Rasmussen | 414/619 |
| 4,718,816 | A * | 1/1988 | King | 414/739 |
| 5,536,133 | A * | 7/1996 | Velez et al. | 414/620 |

OTHER PUBLICATIONS

International Search Report and Written Opinion, dated Jan. 10, 2014, PCT International App. No. PCT/US13/56879, filed Aug. 27, 2013, Cascade Corporation, 8 pgs.

* cited by examiner

*Primary Examiner* — Stephen Vu
(74) *Attorney, Agent, or Firm* — Chernoff Vilhauer McClung & Stenzel, LLP

(57) ABSTRACT

A modular face plate for mounting swing frame roll clamp to a rotator reduces the cost of the face plate and simplifies hydraulic connections to the clamping rams.

14 Claims, 4 Drawing Sheets

SWING FRAME ROLL CLAMP

CROSS-REFERENCE TO RELATED APPLICATIONS

This application claims the benefit of U.S. Provisional App. No. 61/830,742, filed Jun. 4, 2013.

BACKGROUND OF THE INVENTION

The present invention relates to a roll clamp and, more particularly, to a swing frame roll clamping apparatus mountable on a vehicle for engaging, transporting and stacking rolls of paper and other materials.

Pivoting arm roll clamps for mounting on lift trucks and other vehicles are widely used in handling rolls of paper products, such as newsprint and kraft paper, and other materials. Typically, roll clamps are rotatable to engage, transport and deposit a roll with the longitudinal axis of the roll either vertical or horizontal. If the roll is lying on a surface with the axis of the roll horizontal, it is preferable that the arms at the top of the horizontally oriented clamping attachment extend forward of the lift vehicle further than the lower arms so that the upper arm can overreach the roll enabling the clamp pads at the ends of the upper and lower arms to engage the roll at diametrically opposed positions without requiring that the lower arm be pushed under the roll which is likely to cause it to roll away from the clamp. On the other hand, when a roll is transported or stacked with the longitudinal axis vertical, it is preferable that the arms on both sides of the roll extend equally far forward of the lift vehicle to facilitate inserting both arms between closely adjacent rolls without damaging them. Moving the clamp or the roll normal to the roll's longitudinal axis is also often useful to align the clamp or roll without moving the lift vehicle during stacking or during loading or unloading of a transport vehicle or to change the height of the roll slightly when placing a horizontal roll in a machine.

A swing frame type paper roll clamp, such as the paper roll clamp disclosed in House, U.S. Pat. No. 4,435,119, enables the clamp arms on opposing sides of the clamping attachment to be moved toward or away from the vehicle. A rotator is attached to a lift truck or other vehicle and a face plate of the swing frame clamp is attached to the rotator's bearing on the side farthest from the lift vehicle. The face plate is a large monolithic plate including a number of holes for fasteners to secure the face plate to the rotator's bearing and defining a large central aperture in which a revolving hydraulic connection is mounted. Upper and lower subframes, having, generally, I-beam cross-sections, are each pivotally attached to the face plate by pins which engage respective pairs of support blocks welded to and projecting from the face plate above and below each subframe. The clamp arms are pivotally attached to the subframes and are pivoted to clamp or release a load by hydraulic clamping rams which are, respectively, connected to a clamp arm and one of the subframes. Extension or retraction of a swing frame hydraulic ram attached to the face plate and the subframes pivots the subframes about their central connections to the faceplate to swing the opposing ends of the subframes and the attached clamp arms nearer or farther from the lift truck.

Hydraulic fluid from the lift truck flows through the revolving hydraulic connection at the center of the face plate and thence in conduits arrayed across the surface of the face plate to the various hydraulic rams of the clamp. The eight conduits which supply hydraulic fluid to the clamping rams are complex each comprising a U-shaped tubing portion which is connected to a flexible hose portion. Each tube portion includes a first length of tubing extending away the central revolving hydraulic connection toward the side of the face plate opposite of the clamping ram to which the conduit will ultimately be connected. A second length of tubing extends normal to the first length toward either the top or the bottom of the face plate. A relief is provided in a portion the innermost flange of each subframe, on both sides of the central pivot, so that the second lengths of tubing can extend from the middle of the face plate to a point behind the web of the I-shaped subframe. A third length of tubing, bent normal to the second length, extends the conduit behind the web of the respective subframe toward the lateral center of the face plate where the tubing is attached to a hose which is connected to one of the clamping rams. The hose permits the conduits to conform to the movements of the clamping rams as they swing relative to the face plate when the clamp arms are pivoted. The relief in the subframe's flange to accommodate the conduits supplying the clamping rams concentrates stress in the flange and the conduits are difficult to access for assembly or repair, such as replacing a worn hose portion, because they are attached to the face plate behind the subframes.

What is desired is a swing frame paper roll clamp with a face plate that is simpler and less costly to manufacture and enables a less complicated and less intrusive hydraulic fluid connection to the clamping rams.

DETAILED DESCRIPTION OF PREFERRED EMBODIMENTS

Figure 1:
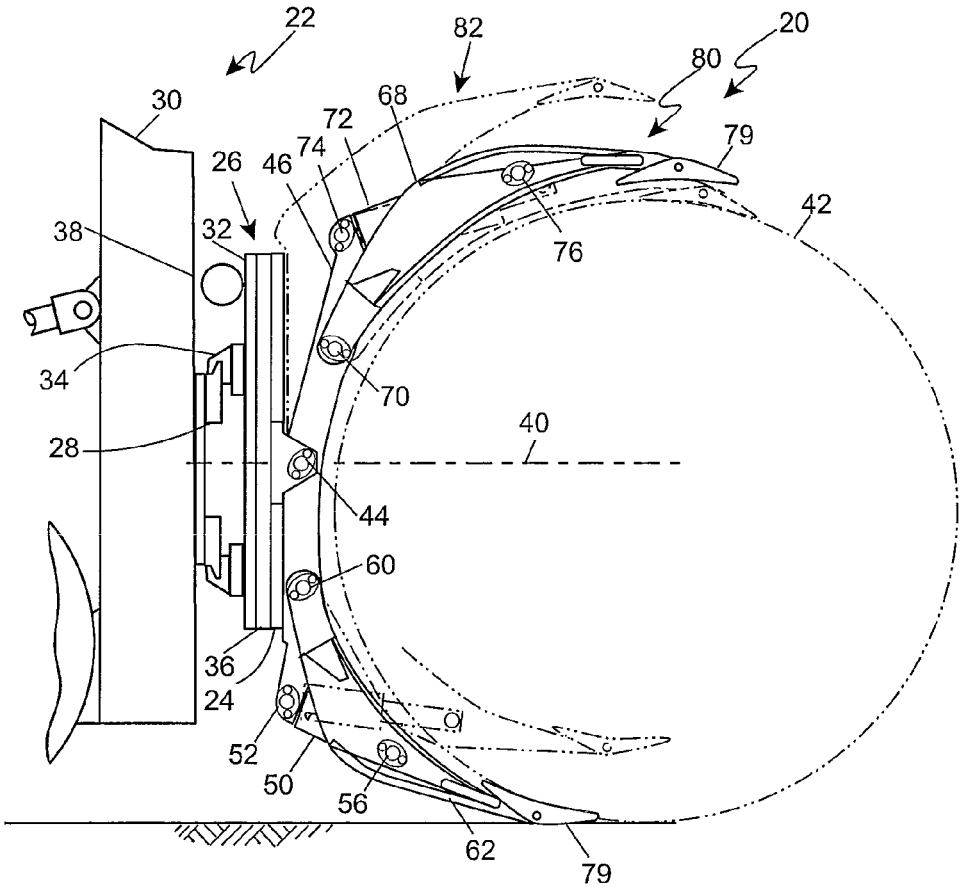
FIG. 1 is a side elevation view of a swing frame paper roll clamp in the bilge position and a portion of a forklift truck.

Referring in detail to the drawings where similar parts are identified by like reference numerals, and, more particularly to FIG. 1, while the exemplary roll clamp designated generally as 20 is mountable on a forklift truck 22, the clamp could be attached to other types of vehicles. A face plate 24 of the roll clamp 20 is attached to rotator 26 which is, in turn, attached to a carriage 28 of the fork lift truck. The carriage is arranged to move upward and downward in the fork lift truck's mast 30 which can also be tilted fore and aft with respect the fork lift truck to change the angular relationship of the clamp and/or engaged roll with respect to the surface supporting the lift truck.

The rotator 26 comprises, generally, a baseplate 32 to which are attached hooks 34 which engage the carriage 28 of the forklift truck. The baseplate 32 is attached to an outer race of a bearing 36. Gear teeth formed on the interior of the inner race of the bearing 36 mesh with gear teeth on a pinion which is rotatable by a hydraulic motor 38. The rotator provides powered rotation of the roll clamp 20 about an axis of rotation 40 generally parallel to the longitudinal axis of the fork lift truck. Rotation of the clamp permits engagement and handling of cylindrical rolls 42 of paper or other material when the central axis of the roll is oriented horizontally, as illustrated in FIG. 1, for example, for loading a roll into a machine such as a printing press, or vertically for transport or stacking.

Figure 2:
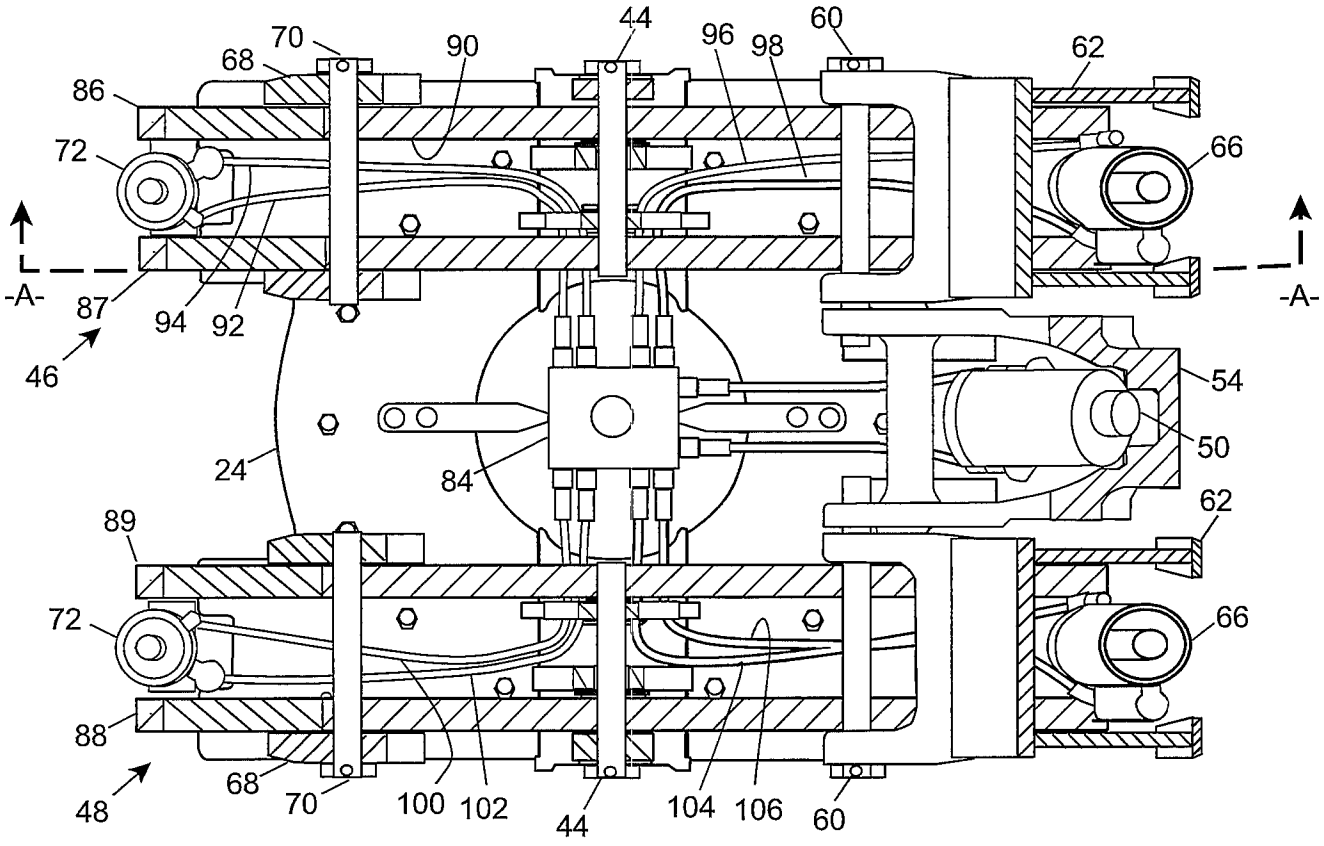
FIG. 2 is a partial front view with portions removed to reveal the underlying structure of the swing frame roll clamp of FIG. 1 rotated to engage a roll with a vertically oriented central axis.
Figure 3:
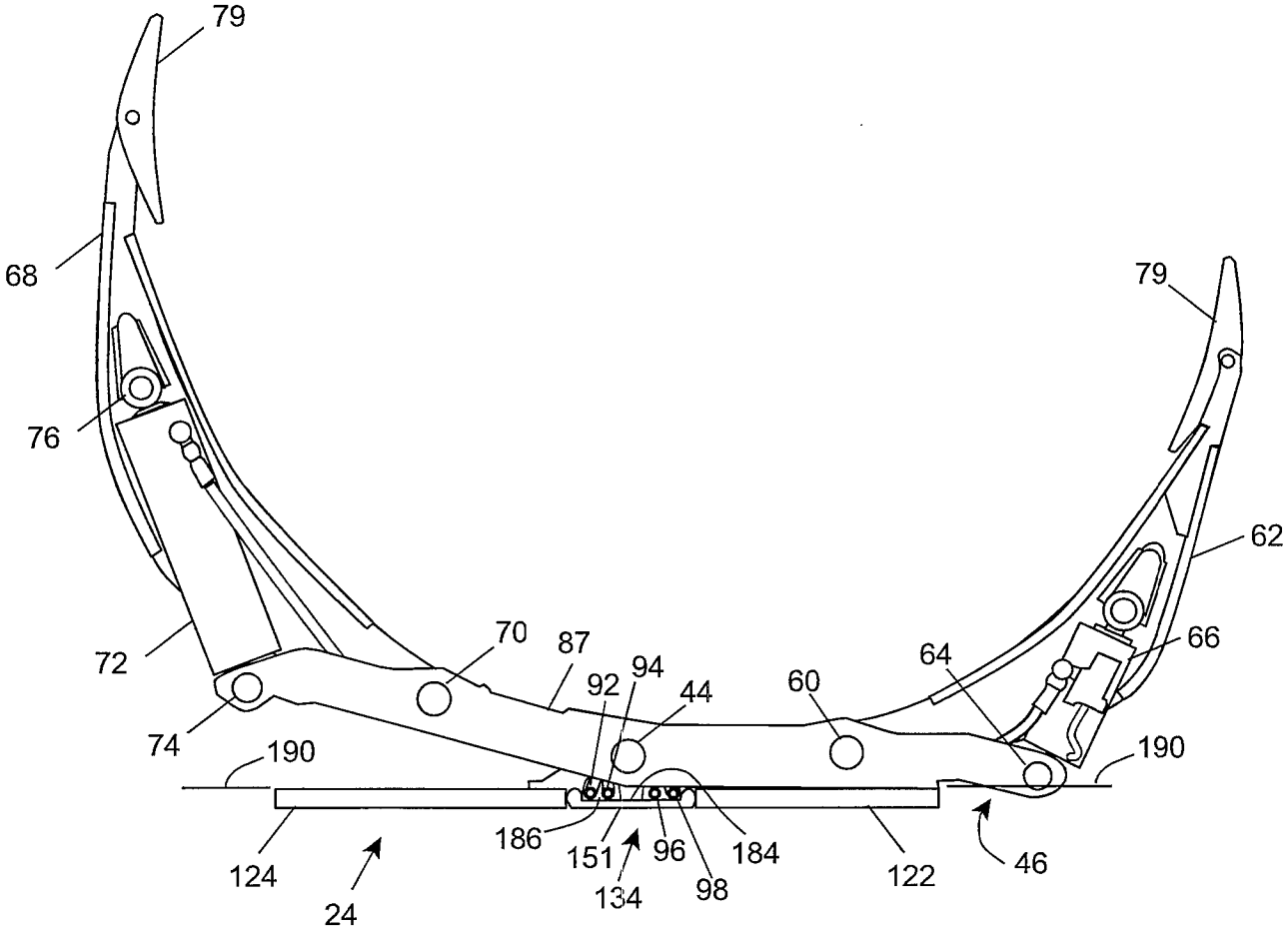
FIG. 3 is a section view of the swing frame roll clamp of FIG. 2 taken along line A-A.

Referring also to FIGS. 2 and 3, pivotally attached to the clamp's faceplate 24 by respective pivot pins 44 is a pair of subframes 46, 48 each comprising a flange 86, 88 distal of the center of the face plate and a flange proximate the center of the face plate 87, 89, respectively. Extension or retraction of a hydraulic swing frame ram 50, pivotally connected to the faceplate 24 at one end by a pin 52 and pivotally connected to a swing arm bracket 54 at the second end by a second pin 56, pivots the subframes with respect to the faceplate 24 about an axis extending transverse to the clamp's axis of rotation 40. The swing ram bracket 54 is rigidly secured to the subframes 46, 48 by the pins 60 that pivotally secure the shorter clamp arm 62 to the subframes and by the pins 64 which secure the short arm clamping rams 66 to the subframe. The longer clamping arm(s) 68 is also pivotally connected to the subframes 46, 48 by pivot pins 70 and is pivoted relative to the subframes by plural hydraulic long arm clamping rams 72 which are connected to the subframes by pins 74 and to the long clamping arm by pins 76. Clamp pads 79, pivotally attached to the distal ends of the long clamping arm 68 and the short clamping arm 62, are arranged for engaging a roll 42 of paper or other material which is secured in the clamping attachment when the long arm clamping rams 72 and the short arm clamping rams 66 are extended, pivoting the clamping arms toward each other.

If the roll 42 is laying on a surface with the axis of the roll horizontal, it is preferable that the upper (long) arm(s) 68 of the roll clamp extend further forward of the lift vehicle than the lower (short) arms) 62 so that the upper arm can overreach the roll enabling the clamp pads 79 on the ends of the long and short clamping arms to engage the roll at diametrically opposed positions without having to push the lower arm under the roll. On the other hand, when the roll is transported or stacked with its longitudinal axis vertical, it is usually preferable that the arms on both sides of the roll extend equally far forward of the lift vehicle to facilitate inserting both arms between closely adjacent rolls without damaging them. In addition, it often useful to move the clamp or a roll transverse to the roll's longitudinal axis to align the clamp or roll without moving the lift vehicle during stacking or during loading or unloading a transport vehicle or to change the height of the roll slightly when placing a horizontally oriented roll in a machine. By extending or retracting the swing frame ram 50, the operator of the forklift truck can pivot the subframes 46, 48 about their central connections to the face plate 24 and move attached clamp arms 62, 68 between an unequal arm length position 80 and an equal arm length position 82 (in phantom).

While the pivoting subframes of a swing frame roll clamp increase the clamp's utility, pivotally attaching the subframes to the face plate increases the cost and the difficulty of manufacturing the face plate and supplying hydraulic fluid to the clamping rams attached to the movable subframes can be complicated and problematic. Correctly locating subframe support blocks and aligning the pivot pin holes in the support blocks on a monolithic face plate is, typically, time consuming and/or requires extensive locating tooling. On the other hand, machining the pivot pin holes after welding the support blocks to the large face plate requires setting up the face plate in a large machine arranged to bore holes in a direction normal to the orientation of the other holes in the faceplate. In addition, each of the hydraulic rams of the clamping attachment must be connected to a revolving hydraulic connection in the center of the face plate by two conduits extending across the front surface of the faceplate but the path of the conduits to the clamping rams is blocked by the centermost flanges of the subframe which preferably pivot into contact with the face plate to reduce an adverse impact on the lift truck's capacity. In prior swing frame clamps, the eight conduits connecting the hydraulic revolving connection to the clamping rams comprised a U-shaped tube to route the conduit away from the support blocks in the center of the face plate and the more highly stressed portions of the subframe; then toward the top or bottom of the faceplate and into the spaces between the flanges of the subframes; and then toward the ram to which the conduit would be connected. A hose portion was connected to the tubing to provide a flexible connection to the clamping rams which move relative to the face plate when pivoting the clamp arms. Plural reliefs, provided in the centermost flange of each subframe to provide clearance for the conduits when the respective end of the subframe was pivoted into contact with the face plate, concentrated stress in the effected flanges of the subframes and connecting the hose portions and the tubing portions of the conduits, during initial assembly or repair, is difficult because the connection is located behind the web of the subframe and accessible only through a small opening.

The inventor realized that a modular face plate assembly comprising unitary swing axis supports affixed to plural plates could simplify the hydraulic connection to the clamping rams; significantly reduce the cost and difficulty of manufacturing the face plate and reduce the stresses in the subframes.

Figure 4:
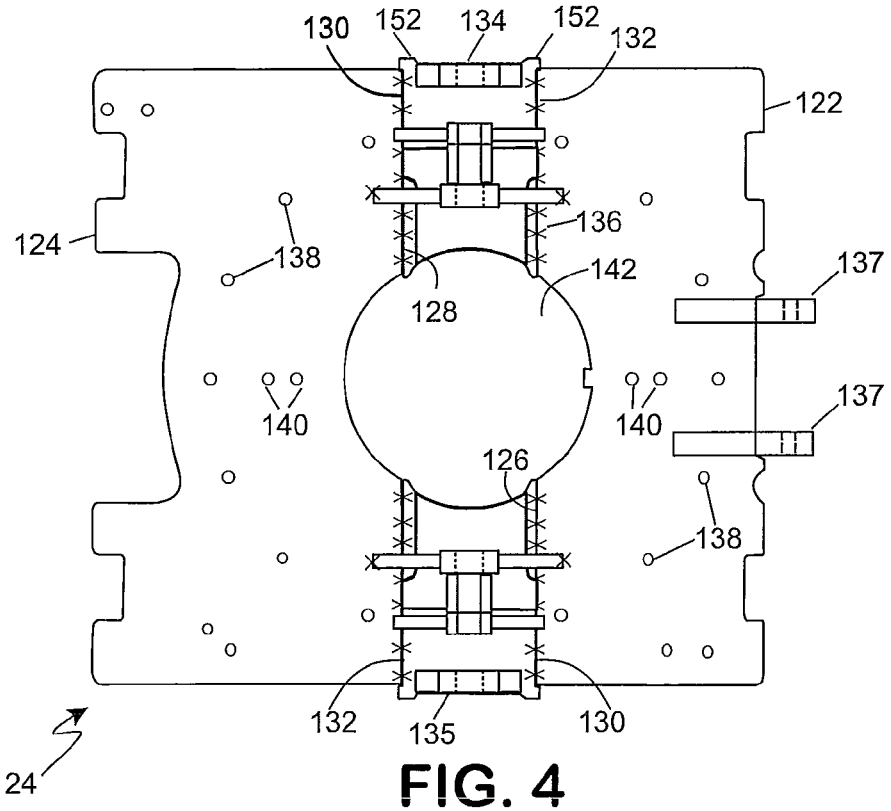
FIG. 4 is a plan view of a modular face plate for the swing frame roll clamp of FIG. 2.
Figure 5:
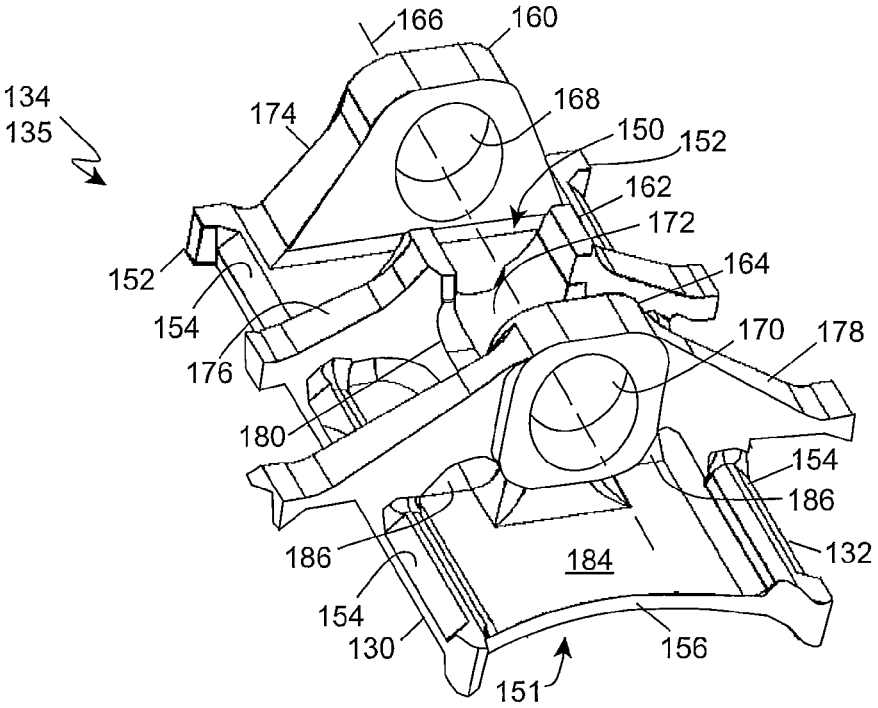
FIG. 5 is a perspective view of a unitary swing axis support.

Referring also to FIGS. 4 and 5, the modular face plate 24 of the swing frame roll clamp 20 comprises a first plate 122 and a second plate 124 having respective edges 126 and 128 which are abutted with opposing edges 130, 132 of plural unitary swing axis supports 134, 135 and welded 136 thereto. Anchor blocks 137 for pivotally connecting the swing frame ram 50 to the face plate 24 are welded to the first plate 122 and a number of holes, including holes 138 for bolting the face plate to the bearing 36 of the rotator 26 and holes 140 for securing the hydraulic revolving connection 84 in a large central aperture 142 in the face plate, are machined in the first plate and the second plate.

The unitary swing axis supports 134, 135 comprise a generally rectangular base 150 having a generally planar back surface 151 and opposing longitudinal edges 130 and 132 for abutment with an edge 126 of the first plate 122 and edge 128 of the second plate 124. Laterally extending locating lugs 152 at one end of the base are engageable with edges of the first 122 and second 124 plates to aid in positioning the plates for welding and portions 154 of the longitudinal edges 130, 132 are beveled to facilitate welding the swing axis supports to the first and second plates. The edge 156 of the base 150 distal of the locating lugs 152 is preferably arcuate to form, in conjunction with portions of the edges 126 and 128 of the first and second plates, the large central aperture 142 of the face plate.

Three swing frame support blocks 160, 162, 164 project outward from a front face of the base 150 of the swing axis support. A hole 168 in the first support block 160, the support block proximate the locating lugs 152, and a hole 170 in the third support block 164, the support block distal of the locating lugs, and an arcuate, U-shaped slot surface 172 in the middle support block 162 are aligned on a centerline 166 to receive a pivot pin 44 which pivotally attaches a subframe 46, 48 to the face plate. Any machining of the support blocks of the swing axis support can be performed in one direction on a machine that is too small to accept a monolithic face plate. Each of the support blocks 160, 162, 164 comprises a laterally projecting fillet portion, respectively 174, 176, 178 to reinforce the support block in directions transverse to the longitudinal edges 130, 132 of the swing axis support and the middle support block 162 includes plural fillets 180 to reinforce the block in the direction of the third support block 164. The unitary swing axis supports are preferably cast, although they may be fabricated or manufactured by another method.

When the swing frame roll clamp 20 is rotated to handle a vertically oriented roll, that is, the subframes are oriented horizontally, the subframes are supported by the respective flange most distant from the center of the face plate. The upper subframe 46 is supported by the middle support block 162 of the upper swing axis support which bears on the lower surface 90 of the upper flange 86 of the subframe while the first support block 162 and the third support block 164 of the upper swing axis support 134 restrain the pivot pin 44 against force acting normally forward from the front surface of the face plate. The lower subframe 48 is supported by the first block 162 of the lower swing axis support 135 which bears on the lower surface of the lower flange 88 of the subframe. The support blocks of the lower swing axis support also resist a compressive force as the subframe is urged toward the face plate by the cantilevered weight of the attachment and load. When the clamp is rotated for handling a horizontally oriented roll, the subframes are supported by at least two of the support blocks which are each reinforced by respective fillets that laterally extend from the support block and to the bases of the swing axis supports 134, 135 and in the case of fillets 176, 178 to the first 122 and second 124 plates.

Supporting the horizontally oriented subframes by their outermost flanges reduces the structural robustness, in a direction parallel to centerline 166, required of the third, centermost, support block 164 allowing apertures 186; to accommodate the passage of respective pairs of hoses 92, 94; 96, 98; 100, 102; 104, 106; to be defined by portions of the fillets 174 and a depressed portion 184 in the front face of the base 150. As best seen in FIG. 3, the first plate 122 and second plate 124 are affixed to the upper 134 and lower 135 swing axis supports with the plate edges abutted with the edges 130, 132 of the swing axis supports and with rear surfaces of the first and second plates co-planar with the back surface 151 of the unitary support axes. The depressed surface portion 184 is offset toward the back of the face plate from the plane 190 defined by the front surfaces of the first and second plates to form a channel behind the subframe, for example subframe 46, for the passage of hydraulic conduits, for example conduits 92, 94, 96, 98 connecting the revolving connection 84 and the clamping rams 72, 66 attached proximate the ends of the subframes. The modular face plate 24 enables a simple flexible conduit connecting the revolving connection and the clamping rams without either shifting the subframe forward which would negatively affect the capacity of the lift truck or providing a stress concentrating relief for the conduits in the flange of the subframe. The unitary swing axes and the modular face plate substantially reduces the time, cost and tooling required to prepare, position and affix the subframe support blocks to the face plate and simplifies the conduits connecting the revolving connection to the clamping rams.

The detailed description, above, sets forth numerous specific details to provide a thorough understanding of the present invention. However, those skilled in the art will appreciate that the present invention may be practiced without these specific details. In other instances, well known methods, procedures, components, and circuitry have not been described in detail to avoid obscuring the present invention.

All the references cited herein are incorporated by reference.

The terms and expressions that have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims that follow.

I claim:

1. A unitary swing axis support for a swing frame clamp, said swing axis support comprising:

(a) a base having a first edge, a second edge opposing said first edge and a third edge;

(b) a first subframe mounting block projecting from said base distal of said third edge;

(c) a second subframe mounting block projecting from said base and spaced apart from said first subframe mounting block toward said third edge; and (d) a third subframe mounting block projecting from said base and spaced apart from said second subframe mounting block proximate said third edge, a portion of said base and a portion of said third subframe mounting block defining an aperture extending between a first side of said third subframe mounting block proximate said third edge and an opposing second side of said third subframe mounting block more distal of said third edge; said base, said first subframe mounting block, said second subframe mounting block and said third subframe mounting block comprising a single unit.

2. The unitary swing axis support of claim 1 comprising a casting.

3. The unitary swing axis support of claim 1 further comprising a fillet extending from said second subframe mounting block toward said third subframe mounting block.

4. The unitary swing axis support of claim 1 wherein:

(a) said first subframe mounting block includes portions defining a first aperture;

(b) said second subframe mounting block includes portions defining a second aperture having a central axis coincident with a central axis of said portions defining said first aperture; and (c) said third subframe mounting block includes portions defining a third aperture having a central axis coincident with said central axis of said portions defining said first aperture.

5. The unitary swing axis support of claim 4 wherein said portions of said second subframe mounting block defining said aperture define an arcuate surface.

6. A face plate for a swing frame clamp, said face plate comprising:

(a) a first unitary swing axis support and a second unitary swing axis support, each comprising:

(i) a base having a first edge, a second edge opposing said first edge and a third edge;

(ii) a first subframe mounting block projecting from said base distal of said third edge;

(iii) a second subframe mounting block projecting from said base and spaced apart from said first subframe mounting block toward said third edge; and (iv) a third subframe mounting block projecting from said base and spaced apart from said second subframe mounting block proximate said third edge, a portion of said base and a portion of said third subframe mounting block defining an aperture extending between a first side of said third subframe mounting block proximate said third edge and an opposing second side of said third subframe mounting block more distal of said third edge; and (b) a first plate affixed to said first swing axis support and said second swing axis support, said first edge of said first swing axis support and said second edge of said second swing axis support in abutment with a first edge of said first plate; and (c) a second plate affixed to said first swing axis support and said second swing axis support, said second edge of said first swing axis support and said first edge of said second swing axis support in abutment with a first edge of said second plate.

7. The face plate of claim 6 wherein said third edge of said first swing axis support, said third edge of said second swing axis support, said first edge of said first plate and said first edge of said second plate define a central aperture of said face plate.

8. The face plate of claim 6 further comprising an anchor for a subframe ram affixed to said second plate.

9. The face plate of claim 6 further comprising a locating lug portion of said first edge of said first subframe axis support, said locating lug portion arranged for abutment with a second edge said first plate.

10. The face plate of claim 9 further comprising a second locating lug portion of said second edge of said first subframe axis support, said second locating lug portion arranged for abutment with a second edge said second plate.

11. The face plate of claim 6 wherein a front surface of said first plate and a front surface of said second plate are arranged substantially co-planar and said portion of said base of said first unitary swing axis support defining said aperture in said third subframe mounting block is offset from said plane of said front surface of said first plate toward an opposing back surface of said first plate.

12. A swing frame roll clamp comprising:

(a) a faceplate having a first surface and including portions defining a substantially central aperture, said face plate including:

(i) a first subframe mounting block projecting from said first surface distal of said aperture;

(ii) a second subframe mounting block projecting from said first surface and spaced apart from said first subframe mounting block and nearer to said central aperture than said first subframe mounting block; and (iii) a third subframe mounting block projecting from said first surface and spaced apart from and nearer to said central aperture than said second subframe mounting block;

(b) an elongate subframe comprising a first flange and a spaced apart second flange, said subframe pivotally attached to said first subframe mounting block and said third subframe mounting block and arranged to pivot about an axis substantially parallel to said first face of said faceplate, said second subframe mounting block resisting displacement of said first flange in a direction of said central aperture of said faceplate and said first subframe mounting block resisting displacement away from said central aperture of said faceplate;

(c) a hydraulic clamping ram pivotally connected to said subframe proximate an end of first flange and said second flange;

(d) a revolving hydraulic connection affixed to said face plate in said central aperture; and (e) a hydraulic fluid conduit connecting said revolving hydraulic connection and said clamping ram, said conduit passing between said face plate and said second flange of said subframe through an aperture connecting a first side and a second side of said third subframe mounting block and defined by portions of said third subframe mounting block including portions offset from said first surface toward an opposing second surface of said face plate.

13. The swing frame roll clamp of claim 12 further comprising:

(a) a swing frame ram anchor affixed to said face plate;

(b) a swing frame ram bracket affixed to said subframe by a first pin pivotally connecting said clamping ram to said subframe and a second pin pivotally connecting said subframe and a clamp arm; and (c) a swing frame ram pivotally connected to said subframe anchor and to said swing frame ram bracket, extension and retraction of said swing frame ram pivoting said subframe about said connection to said first subframe mounting block.

14. The swing frame roll clamp of claim 12 wherein said face plate comprises:

(a) a first plate having a first edge;

(b) a second plate having a first edge; and (c) a unitary swing axis support including said first subframe mounting block, said second subframe mounting block and said third subframe mounting block and affixed to said first edge of said first plate and said first edge of said second plate.

* * * * *